US007325493B2

(12) United States Patent
Helmstädter et al.

(10) Patent No.: US 7,325,493 B2
(45) Date of Patent: Feb. 5, 2008

(54) SHEET-FED ROTARY PRINTING PRESS HAVING A THREE-DRUM REVERSING DEVICE AND METHOD OF TRANSPORTING A SHEET THROUGH A THREE-DRUM REVERSING DEVICE

(75) Inventors: Karl-Heinz Helmstädter, Heidelberg (DE); Hans Peter Boguhn, Heidelberg (DE); Hans-Peter Hiltwein, Waghäusel (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/330,441

(22) Filed: Dec. 27, 2002

(65) Prior Publication Data

US 2003/0121433 A1 Jul. 3, 2003

(30) Foreign Application Priority Data

Dec. 27, 2001 (DE) ..... 101 64 255

(51) Int. Cl.
*B41F 13/24* (2006.01)

(52) U.S. Cl. ..... 101/230; 101/229; 101/231; 101/246; 101/408; 101/409

(58) Field of Classification Search ..... 101/229, 101/230, 231, 246, 408, 409, 410; 271/204, 271/205, 206, 196, 277
See application file for complete search history.

(56) References Cited

U.S. PATENT DOCUMENTS 4,024,814 A 5/1977 Becker
4,621,576 A * 11/1986 Wirz ..... 101/230
4,732,084 A * 3/1988 Wirz ..... 101/177
4,856,426 A 8/1989 Wirz
4,869,166 A * 9/1989 Mathes ..... 101/230
5,598,779 A * 2/1997 Haas et al. ..... 101/230
5,787,810 A * 8/1998 Stephan ..... 101/232
5,931,093 A * 8/1999 Walther et al. ..... 101/232
5,979,318 A * 11/1999 Helmstadter ..... 101/232
6,089,156 A * 7/2000 Stephan ..... 101/230
6,254,094 B1 7/2001 Becker et al.

(Continued)

FOREIGN PATENT DOCUMENTS

DE 34 19 762 C2 11/1985

(Continued)

*Primary Examiner*—Judy Nguyen
*Assistant Examiner*—Kevin D. Williams
(74) *Attorney, Agent, or Firm*—Laurence A. Greenberg; Werner H. Stemer; Ralph E. Locher

(57) ABSTRACT

A sheet-fed rotary printing press for selective recto printing and recto and verso printing includes a three-drum reversing device having three cylinders cooperatively disposed behind one another between respective impression cylinders of two adjacent printing units. The three cylinders include one at least double-size transfer cylinder, one at least double-size storage drum, and one at least single-size reversing drum. Grippers prescribe a circular periphery of the transfer cylinder. The transfer cylinder has an outer contour smaller than the circular periphery prescribed by the grippers of the transfer cylinder. Other grippers prescribe a circular periphery of the reversing drum. The reversing drum has an outer contour smaller than the circular periphery prescribed by the grippers of the reversing drum. A method of operating the three-drum reversing device is also provided.

12 Claims, 3 Drawing Sheets

U.S. PATENT DOCUMENTS

| | | | | |
|---|---|---|---|---|
| 6,279,898 | B1 * | 8/2001 | Stephan | 271/195 |
| 6,619,201 | B1 * | 9/2003 | Becker et al. | 101/230 |
| 6,729,233 | B2 * | 5/2004 | Knopp et al. | 101/232 |
| 2002/0069773 | A1 * | 6/2002 | Stephan | 101/230 |
| 2002/0135123 | A1 * | 9/2002 | Maul et al. | 271/277 |
| 2002/0174785 | A1 * | 11/2002 | Sasaki | 101/229 |

FOREIGN PATENT DOCUMENTS

| | | | |
|---|---|---|---|
| DE | 197 00 370 | A1 | 7/1998 |
| DE | 197 13 361 | A1 | 10/1998 |
| DE | 198 33 901 | A1 | 2/2000 |
| DE | 100 11 436 | A1 | 11/2000 |
| DE | 199 49 412 | A1 | 4/2001 |
| DE | 199 57 230 | A1 | 5/2001 |
| DE | 100 00 308 | A1 | 7/2001 |
| EP | 1 103 375 | A2 | 5/2001 |
| JP | 09193348 | A | 7/1997 |

* cited by examiner

SHEET-FED ROTARY PRINTING PRESS HAVING A THREE-DRUM REVERSING DEVICE AND METHOD OF TRANSPORTING A SHEET THROUGH A THREE-DRUM REVERSING DEVICE

BACKGROUND OF THE INVENTION

Field of the Invention

The invention relates to a sheet-processing machine, especially a sheet-fed rotary printing press, having a three-drum reversing device or turning device. The invention also relates to a method of transporting a sheet through a three-drum reversing device.

In order to be able to print on both sides of a sheet, it has become known heretofore to place a reversing or turning device between two mutually adjacent printing units, which grips the sheet in accordance with the trailing-edge reversing principle and transfers the sheet to the cylinders of the next following printing unit with a reversing drum.

A device of that type is disclosed, for example, by German Published, Non-prosecuted Patent Application DE 199 57 230 A1, wherein a reversing device for three-drum reversing or turning is disclosed. The reversing device includes a double-size or higher multiple-size transfer cylinder, a double-size or higher multiple-size storage drum and an at least single-size reversing or turning drum. In that regard, it is noted that the single size corresponds to the size of a conventional printing-unit cylinder, i.e., a blanket, an impression or a plate cylinder of a printing unit.

SUMMARY OF THE INVENTION

It is accordingly an object of the invention to provide a sheet-fed rotary printing press having a three-drum reversing device and a method of transporting a sheet through a three-drum reversing device, which overcome the hereinafore-mentioned disadvantages of the heretofore-known devices and methods of this general type, in which cylinders and drums involved in a reversing operation are constructed in such a way that virtually contact-free sheet transport is achievable in the vicinity of the reversing device and in which the sheet is gripped at edges thereof in a conventional manner.

With the foregoing and other objects in view, there is provided, in accordance with the invention, a sheet-fed rotary printing press for selective recto printing and recto and verso printing, comprising a three-drum reversing device having three cylinders cooperatively disposed behind one another between respective impression cylinders of two adjacent printing units. The three cylinders include one at least double-size transfer cylinder, one at least double-size storage drum, and one at least single-size reversing drum. Grippers prescribe a circular periphery of the transfer cylinder. The transfer cylinder has an outer contour smaller than the circular periphery prescribed by the grippers of the transfer cylinder. Other grippers prescribe a circular periphery of the reversing drum. The reversing drum has an outer contour smaller than the circular periphery prescribed by the grippers of the reversing drum.

In accordance with another feature of the invention, the transfer cylinder has a pneumatically actuatable guide device.

In accordance with a further feature of the invention, the guide device matches the circular periphery of the transfer cylinder and is disposed at a spaced distance therefrom.

In accordance with an added feature of the invention, the storage drum has suction devices in a sheet supporting region thereof.

In accordance with an additional feature of the invention, the storage drum has trailing edge suckers and a stationarily disposed blast device.

In accordance with yet another feature of the invention, the blast device is aligned for urging the sheet into active range of the trailing edge suckers.

In accordance with yet a further feature of the invention, the sheet-fed rotary printing press further includes blast or fan devices disposed in a sheet transport region of the reversing drum for assuring a smooth sheet run during a reversing operation.

In accordance with yet an added feature of the invention, the sheet-fed rotary printing press further includes blast devices disposed in a wedge pocket region on a sheet outlet side between the reversing drum and the impression cylinder of a respective printing unit for preventing the trailing edge of the sheet from flapping over.

In accordance with yet an additional feature of the invention, the sheet-fed rotary printing press further includes sheet guide devices disposed on the impression cylinder for pressing the sheet against the surface of the impression cylinder.

With the objects of the invention in view, there is also provided a method of transporting a sheet through a three-drum reversing device in a recto printing and a recto and verso printing operation. The reversing device includes a transfer cylinder, a storage drum and a reversing drum. The method comprises guiding the sheet in the region of the transfer cylinder on a path disposed at a distance from the circumference of the transfer cylinder and from stationary guide devices associated therewith. The sheet is guided in the region of the storage drum while simultaneously fixing the sheet on the surface of the storage drum. The sheet is guided in the region of the reversing drum on a path disposed at a distance from the circumference of the reversing drum and from stationary guide devices associated therewith.

Provision is therefore advantageously made for the cylinders of the reversing device to have an outer contour which, in comparison with the row of grippers involved in the sheet transport, respectively has a set-back surface and a sheet transport surface, that lie within the circular periphery described or prescribed by the rows of grippers.

Due to this measure, the freshly printed side of the sheet does not come into contact with the surface of the transfer cylinder. Provision is also made for simultaneously constructing the outer contour of the at least single-size reversing drum likewise with a set-back surface, and for providing it with an outer contour which lies within the circular periphery described by the row of grippers. Therefore, the freshly printed sheet can be guided without contact through the transfer gap between the storage drum and the reversing drum, both during recto printing and during recto and verso printing operation.

In advantageous support of the contact-free sheet run in the region of the three-drum reversing device, a pneumatically actuatable nozzle guide plate is provided on the transport path between the preceding impression cylinder and the storage drum. The guide plate is adapted or matched to the circular periphery described or prescribed by the rows of grippers of the transfer cylinder.

Further blast or blowing and suction devices assist the contact-free sheet run in the reversing region due to their advantageous geometric configuration and, in fact, not just during the reversing operation but also during a pure recto printing operation.

Other features which are considered as characteristic for the invention are set forth in the appended claims.

Although the invention is illustrated and described herein as embodied in a sheet-fed rotary printing press having a three-drum reversing device and a method of transporting a sheet through a three-drum reversing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
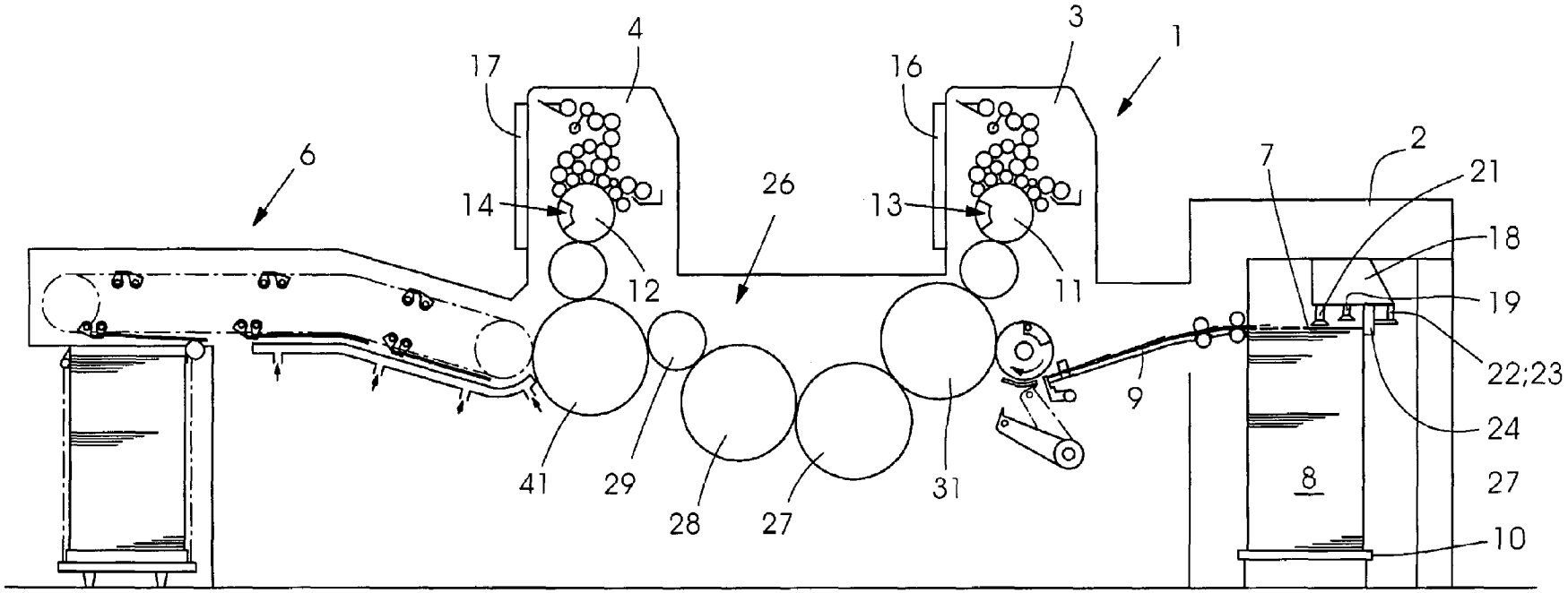
FIG. 1 is a diagrammatic, side-elevational view of a sheet-fed rotary printing press embodying the invention.

Referring now to the figures of the drawings in detail and first, particularly, to FIG. 1 thereof, there is seen a rotary printing press, for example a printing press 1 for processing sheets 7, which has a feeder 2, at least one respective printing unit 3, 4 and a delivery 6. The sheets 7 are taken from a sheet pile or stack 8 and fed, singly or in shingled or overlapped manner, over a feed table 9 to the printing units 3 and 4 which, in a conventional manner, are provided with respective plate cylinders 11 and 12. The respective plate cylinders 11 and 12 have a device 13, 14 for fixing flexible printing plates thereon. Furthermore, a respective device 16, 17 is assigned to each plate cylinder 11, 12 for semi-automatically or fully automatically effecting a printing plate change.

The sheet pile lies on a controllably liftable pile plate 10. Removal of a sheet 7 takes place from the top of the sheet pile 8 by a so-called suction head 18 which, amongst others, has a number of lifting and dragging suckers 19, 21 for singling or individually separating the sheets 7. Blowing or blast devices 22 for loosening the top sheet layers, and sensing elements 23 for tracking the sheet pile 8, are furthermore provided. A number of side and rear stops are provided in order to align the sheet pile 8, in particular the top sheets 7 of the sheet pile 8.

Figure 2:
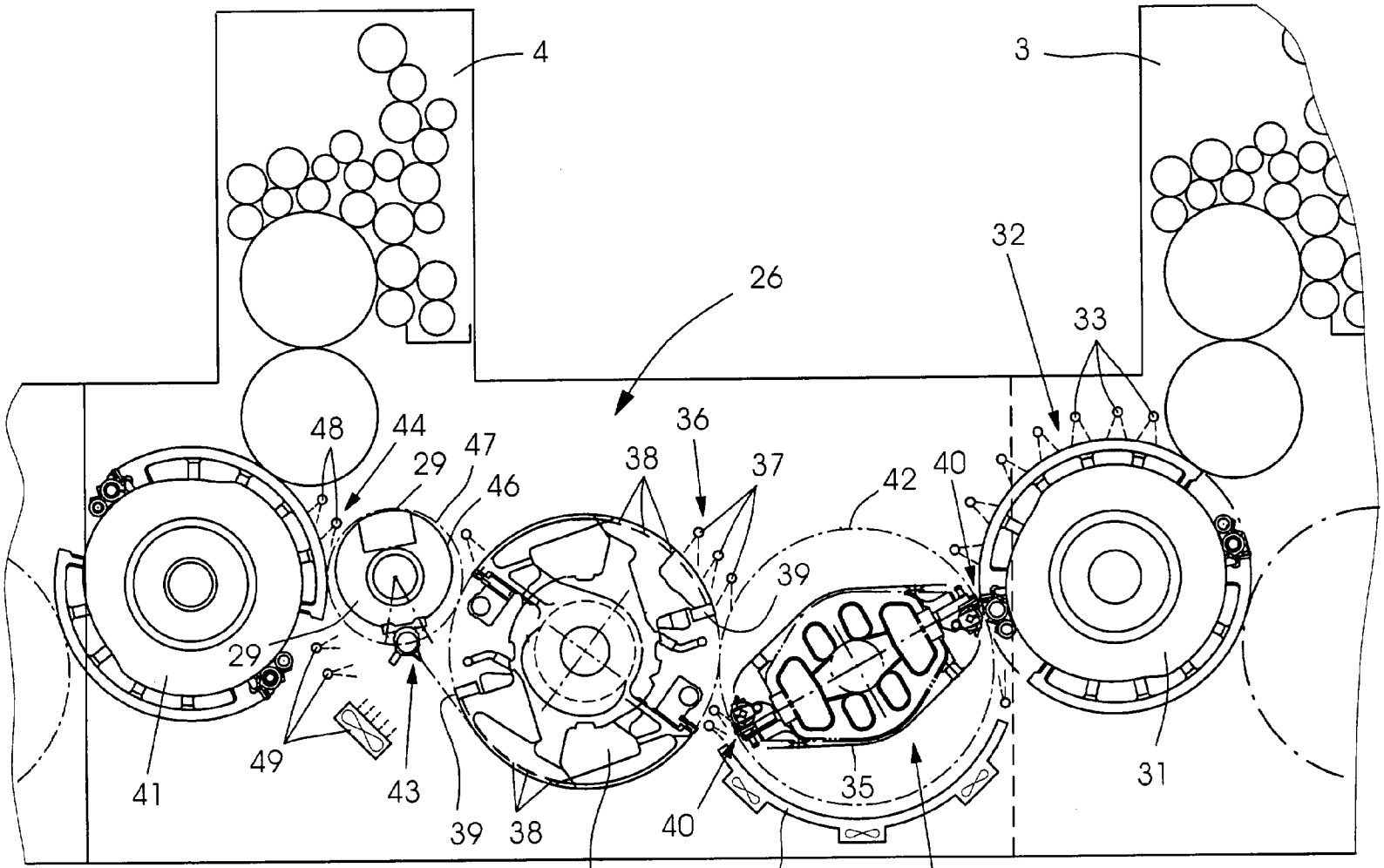
FIG. 2 is an enlarged, fragmentary, side-elevational view of FIG. 1 diagrammatically showing a sheet-transport path according to the invention in the vicinity of an embodiment of a reversing device for reversing a sheet by a single-size reversing drum.

A reversing or turning device 26 for reversing the sheets 7 to be processed is provided between two printing units 3 and 4 disposed adjacent one another. The reversing device 26 is actuatable in such a way that the sheets 7 can be processed either in the recto or single-side printing mode, or in the recto and verso or first-form and perfector printing mode. The reversing device 26 is provided for three-drum reversing or turning and has, as viewed in sheet transport direction, successively following each other: a double or more-size transfer cylinder 27, a double or more-size storage drum 28 and an at least single-size reversing or turning drum 29. In the region or vicinity of the sheet transport path, an impression cylinder 31 of the printing unit 3 is provided with a guide device 32, as shown in FIG. 2, which includes blast tubes 33 in a virtually fixed or stationary configuration. As shown further in FIG. 2, the blast tubes 33 are directed towards the freshly printed sheet 7 so that the latter is pressed against the impression cylinder 31 in order to prevent slippage as the sheets run off. The sheet 7 is transferred by the leading edge thereof to a row of grippers 40 belonging to the transfer cylinder 27. An outer contour 35 of the transfer cylinder 27 is, at least in the region of the printed image, in this case set back so far and located within a circular periphery 42 defined by the row of grippers 40 to such an extent that a sufficiently great distance between the surface of the transfer cylinder 27 and the printed image is assured.

A stationary guide device, for example a nozzle guide plate 34, which matches or is conformed with the circular periphery 42, is provided in the region or vicinity of the transport path between the impression cylinder 31 and the following storage drum 28. This stationary, pneumatically operated guide device 34 holds the sheets on a prescribable path, counter to radially outwardly acting forces.

The sheet 7 is gripped at the leading edge thereof by a row of grippers belonging to the storage drum 28 and, with the fresh printed image directed outwardly in recto and verso or perfector printing, is guided around the storage drum 28 until a row of grippers 43 of the reversing drum 29 grips the trailing edge of the sheet 7. Blowing or blast devices 36 in the form of blast tubes 37, which are disposed in a stationary configuration and provided in a transfer region 44 of the transfer cylinder 27 and the storage drum 28, are directed towards the outer surface of the storage drum 28 and blow on the sheet 7 in such a manner that the sheet 7 is transported in a well fixed position. In addition, the storage drum 28 is equipped with trailing edge suckers 39. These likewise assist the actions of holding and fixing the sheet 7 on the storage drum 28, in particular in the region lying downstream from the transfer point to the reversing drum 29. These trailing edge suckers 39 hold the sheet trailing edge during the reversing operation until the edge is gripped by the row of grippers 43 of the following turning drum 29.

In particular, the trailing edge of the sheet 7 is also fixed in a recto printing operation. After the sheet leading edge has been transferred to the row of grippers 43 of the reversing drum 29, the sheet 7 is transported simultaneously by the row of grippers 43 and by the trailing edge suckers 39 of the storage drum 28.

Optionally, or also additionally to the trailing edge sucker 39, the storage drum 28 has suction devices 38 which, for example, include suction openings that are distributed over the outer surface of the storage drum 28 and are activatable in the region of the sheet format.

After the transfer of the sheet by the row of grippers 43 of the reversing drum 29, the sheet 7 is transferred to the following impression cylinder 41 of the printing unit 4. In this regard, in recto printing, the printed image faces towards the interior of the reversing drum 29. In order to ensure that the printed image is guidable by the reversing drum 29 without contact, an outer contour 46 is set back an extent and has a surface lying within a circular periphery 47 defined by movement of the row of grippers 43, respectively. Due to this measure, there is sufficient space between the freshly printed image and the outer surface of the reversing drum 29.

During a recto printing operation, the measure of transporting the sheets simultaneously at the leading edge and at the trailing edge, in conjunction with the set-back outer contour 46 of the reversing drum 29, ensures that the freshly printed image cannot come into contact with the reversing drum 29.

In order, in particular, to prevent the end of the sheet from turning or flapping up after the transfer of the sheet 7 from the reversing drum 29 to the impression cylinder 41, blowing or blast devices 48 are disposed above the impression cylinder 41 in the sheet transport region (pocket or wedge 44) between the reversing drum 29 and the impression cylinder 41. During a recto and verso printing operation, the printed image is on the side facing away from the reversing drum, so that in that case, without any further measures, smearing is ruled out on the reversing drum.

Blowing or blast and fan devices 49 disposed underneath the reversing drum 29 assist in sheet guidance during the reversing or turning operation and prevent the end of the sheet from turning or flapping over and therefore making prematurely early contact with the impression cylinder 41.

Figure 3:
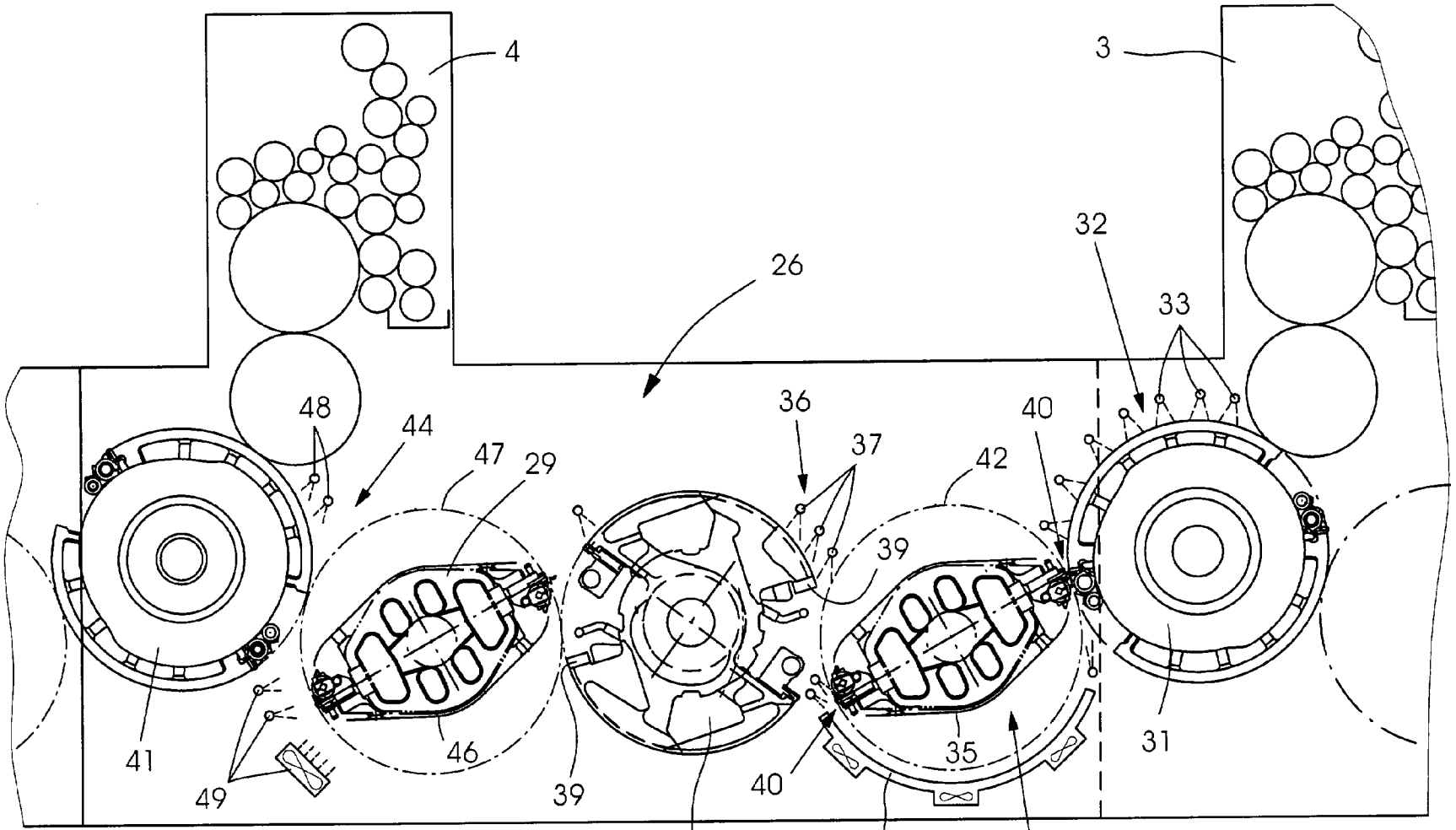
FIG. 3 is another fragmentary, side-elevational view similar to FIG. 2 diagrammatically showing the sheet-transport path according to the invention in the vicinity of another embodiment of the reversing device for reversing a sheet by a double-size reversing drum.

In a further embodiment according to FIG. 3, the reversing drum 29 is constructed as a double-size cylinder, i.e., double the size of the conventional impression, blanket and plate cylinders of a conventional printing unit. The large radius is beneficial to the transport behavior, in particular, when thick paper, such as cardboard or paste board, is being processed.

In the method according to the invention of transporting a sheet through a three-drum reversing or turning device in a recto printing and a recto and verso printing operation, the following method steps are performed:

guiding the sheet in the region or vicinity of the transfer cylinder 27 on a path disposed at a distance from the circumference of the transfer cylinder 27 and from the stationary guide devices 34;

guiding the sheet in the region or vicinity of the storage drum 28 while simultaneously fixing the sheet on the surface of the storage drum 28; and guiding the sheet in the region or vicinity of the reversing drum 29 on a path disposed at a distance from the circumference of the reversing drum 29 and from the stationary guide devices 49.

We claim:

1. In a sheet-fed rotary printing press for selective recto printing and recto and verso printing, having printing unite with respective impression cylinders, the improvement comprising:

a three-drum reversing device having three cylinders cooperatively disposed behind one another between the impression cylinders of an adjacent two of the printing units;

said three cylinders being one at least double-size transfer cylinder, one at least double-size storage drum, and one single-size reversing drum;

said storage drum having trailing edge suckers and additionally having suction devices in a sheet supporting region thereof;

said transfer cylinder having grippers prescribing a circular periphery of said transfer cylinder, and said transfer cylinder having an outer contour located within said circular periphery prescribed by said grippers of said transfer cylinder for transporting a sheet on said transfer cylinder at a distance from said outer contour of said transfer cylinder; and said reversing drum having grippers prescribing a circular periphery of said reversing drum, and said reversing drum having an outer contour located within said circular periphery prescribed by said grippers of said reversing drum for transporting the sheet on said reversing drum at a distance from said outer contour of said reversing drum.

2. The sheet-fed rotary printing press according to claim 1, wherein said transfer cylinder has a pneumatically actuatable guide device.

3. The sheet-fed rotary printing press according to claim 2, wherein said guide device matches said circular periphery of said transfer cylinder and is disposed at a spaced distance therefrom.

4. The sheet-fed rotary printing press according to claim 1, wherein said storage drum has a stationarily disposed blast device.

5. The sheet-fed rotary printing press according to claim 4, wherein said blast device is aligned for urging the sheet into active range of said trailing edge suckers.

6. The sheet-fed rotary printing press according to claim 1, further comprising blast devices disposed in a sheet transport region of said reversing drum for assuring a smooth sheet run during a reversing operation.

7. The sheet-fed rotary printing press according to claim 1, further comprising f an devices disposed in a sheet transport region of said reversing drum for assuring a smooth sheet run during a reversing operation.

8. The sheet-fed rotary printing press according to claim 1, further comprising blast devices disposed in a wedge pocket region on a sheet outlet side between said reversing drum and the impression cylinder of a respective printing unit, for preventing the trailing edge of the sheet from flapping over.

9. The sheet-fed rotary printing press according to claim 1, further comprising sheet guide devices disposed on the impression cylinder for pressing the sheet against the surface of the impression cylinder.

10. A method of transporting a sheet through a three-drum reversing device in a recto printing and a recto and versa printing operation, which comprises:

providing the reversing device with a transfer cylinder having stationary guide devices associated with the transfer cylinder, a storage drum having trailing edge suckers and additionally having suction devices in a sheet supporting region thereof, and a reversing drum having stationary guide devices associated with the reversing drum;

guiding the sheet in a region of the transfer cylinder on a path disposed at a distance from an outer contour of the transfer cylinder and from the stationary guide devices associated with the transfer cylinder; guiding the sheet in a region of the storage drum while simultaneously fixing the sheet on a surface of the storage drum; and guiding the sheet in a region of the reversing drum on a path disposed at a distance from an outer contour of the reversing drum and from the stationary guide devices associated with the reversing drum.

11. The sheet-fed rotary printing press according to claim 1, wherein said suction devices include suction openings distributed over an outer surface of said storage drum.

12. The method according to claim 10, wherein the suction devices include auction openings distributed over an outer surface of the storage drum.

* * * * *